United States Patent [19]

Hibell

[11] 4,275,389

[45] Jun. 23, 1981

[54] ELECTRICAL ASSEMBLY

[75] Inventor: Ernest G. Hibell, Birmingham, England

[73] Assignee: Lucas Industries Limited, Birmingham, England

[21] Appl. No.: 85,872

[22] Filed: Oct. 18, 1979

[30] Foreign Application Priority Data

Nov. 1, 1978 [GB] United Kingdom ..... 43854/78

[51] Int. Cl.[3] ..... G08B 3/00

[52] U.S. Cl. ..... 340/388; 340/404

[58] Field of Search ..... 340/388, 404

[56] References Cited

U.S. PATENT DOCUMENTS

| | | | |
|---|---|---|---|
| 3,456,254 | 7/1969 | Dougall | 340/388 |
| 3,656,155 | 4/1972 | Parkes | 340/388 |
| 4,149,153 | 4/1979 | Shigemori | 340/388 |

FOREIGN PATENT DOCUMENTS

| | | |
|---|---|---|
| 2072846 | 8/1971 | France . |
| 2151364 | 3/1973 | France . |
| 1342717 | 1/1974 | United Kingdom . |

*Primary Examiner*—Harold I. Pitts

*Attorney, Agent, or Firm*—Schwartz, Jeffery, Schwaab, Mack, Blumenthal & Koch

[57] ABSTRACT

An electrical horn has a hollow body fitted with a diaphragm secured to an armature. A self-supporting coil is disposed with clearance in a recess in the body. The coil has no central former but is provided with upper and lower electrically insulating flanges. The flange has laterally projecting support portions engaging the body. The support portion has an integral upstanding post fitted with an electrically conducting sleeve. Mounted in stacked relationship on the support portion and around the post and sleeve are an eyelet and an electrical connector. The post and sleeve are deformed to produce a head which holds the eyelet and electrical connector in engagement without the need to use a rivet extending through the support portion and the body. This reduces the risk of entry of water into the body in service. The lack of a central former for the coil improves air circulation therearound.

16 Claims, 5 Drawing Figures

ELECTRICAL ASSEMBLY

Figure 1:
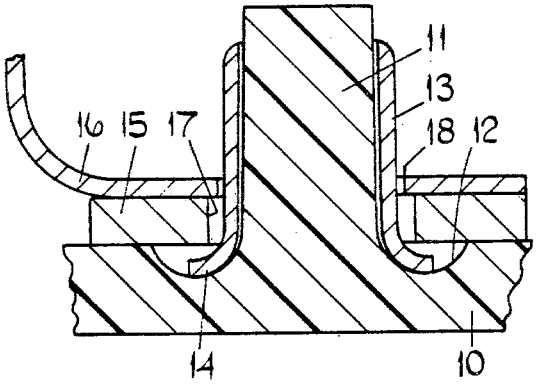

This invention relates to an electrical assembly and more particularly, though not exclusively, to an electrical horn.

Electrical horns generally comprise a dished body having a mounting flange at an open end thereof, and a diaphragm assembly which is secured around its periphery to the mounting flange of the body. Within the body of one known form of horn is carried an electrical coil mounted on an electrically insulating former which consists of a sleeve extending axially through the coil and a pair of integral annular side flanges extending radially outwardly from opposite ends of the sleeve to overlie the ends of the coil. The assembly of coil and former is retained within a recess within the body opposite the open end thereof by means of a plate which is secured to the body and extends across the recess. In one known form of horn, one end of the coil is secured to an electrical terminal externally of the body and which is electrically connected with the aforesaid terminal by means of a rivet which extends through the body, an insulating sleeve surrounding the rivet in order to prevent direct electrical connection between the rivet and the body which is electrically conducting. The other end of the coil is connected to another plate mounted within the body. A configurated metal part carrying a fixed contact of a contact breaker set is electrically connected with this plate and secured within the body by means of a rivet which passes through the configurated metal part, said another plate and through the body. In this case, the rivet is actually engaged with the body but is insulated from the configurated metal part and the plate engaged therewith. A movable contact of the contact breaker set is mounted on a blade spring which is secured by means of a rivet to the body so as to be electrically connected therewith. The blade spring is disposed in a position in which it is engaged by part of the diaphragm assembly in use so as to separate the two contacts when the diaphragm assembly has been attracted by the coil. The contact breaker set provides a make-and-break mechanism so that vibration of the diaphragm can take place for sound-making purposes.

With such a construction, it will be appreciated that a large number of rivets are provided which extend through the body. A disadvantage of providing rivets through the body is that it is difficult to prevent entry of water into the body in the region of the rivets.

It is therefore an object of one aspect of the present invention to provide an electrical connection which enables the above disadvantages to be obviated or mitigated.

A further disadvantage of the above-described horn is that, because the coil is supported on a former having a sleeve disposed internally of the coil, inadequate cooling of the coil can take place on extended operation of the horn in service.

It is thus an object of another aspect of the present invention to obviate or mitigate the above disadvantage.

According to one aspect of the present invention, there is provided an electrical assembly comprising an electrically insulating support member, at least two electrically conducting members mounted in stacked relationship on the support member, an electrically insulating post extending from the support member, an electrically conducting sleeve mounted on the post, the post and the sleeve extending through aligned apertures in the respective electrically conducting members and being deformed on the opposite side of the stack of electrically conducting members to the electrically insulating support member so as to secure the stack to the electrically insulating support member.

Preferably, the sleeve and the post are deformed to provide an enlarged head portion on said opposite side of the stack so that the sleeve engages the outermost electrically conducting member around the aperture therein.

Preferably also, the electrically insulating support member is provided with a downwardly and outwardly curved portion around the post and the end of the sleeve adjacent the electrically insulating support member is deformed so as to lie against said surface and to be in contact with the electrically conductive member adjacent the support member. Preferably, the downwardly and outwardly curved surface is provided as a wall of an annular recess in the electrically insulating support member around the post.

Also according to said one aspect of the present invention, there is provided a method of making an electrical connection comprising the steps of forming a structure in which an electrically insulating support member has at least two electrically conducting members stacked thereon and a deformable, electrically insulating post having a deformable electrically conducting sleeve thereon extends through aligned apertures in the respective electrically conducting members, and deforming portions of the post and sleeve on an opposite side of the stack of electrically conducting members to secure the stack to the electrically insulating support member.

According to another aspect of the present invention, there is provided an electrical coil assembly comprising a self-supporting electrical coil, a pair of electrically insulating flanges or cheeks at opposite ends of the coil, and means holding the flanges or cheeks against the respective ends of the coil, said holding means being disposed externally of the coil and spaced from the outer periphery thereof.

With the above form of construction, no part of the holding means need be provided internally of the coil so that an improved air cooling of the coil can occur compared with the case where the coil is not self-supporting and is wound onto a former which includes an electrically insulating sleeve disposed internally of the coil in contact with the inner periphery thereof.

Preferably, said holding means comprises (i) a body having a recess in which said coil and said flanges or cheeks are disposed, one of the flanges or cheeks abutting against a base of the recess and (ii) at least one retainer member which retains the other flange or cheek in position, said retainer member projecting outwardly of an open end of the recess and being secured to the body.

Said at least one retainer member may be defined by a portion extending integrally of said other flange or cheek and/or or it may be a separate retainer member which is engaged with the flange or cheek. However, in a preferred construction, said at least one retainer member comprises a pair of members extending integrally from said other cheek and a further separate retainer member extending across the open end of the recess.

Also according to the present invention there is provided an electrical horn including an electrical assembly according to said one aspect of the present invention and/or an electrical coil assembly according to said another aspect of the present invention.

Figure 2:
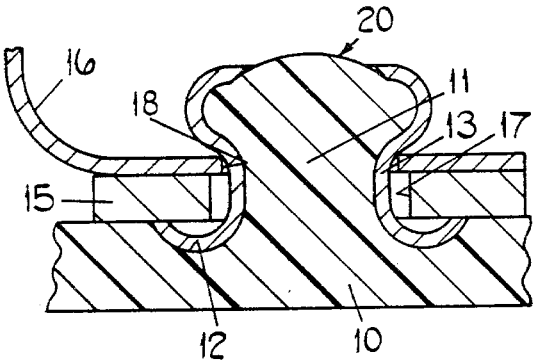
Figure 3:
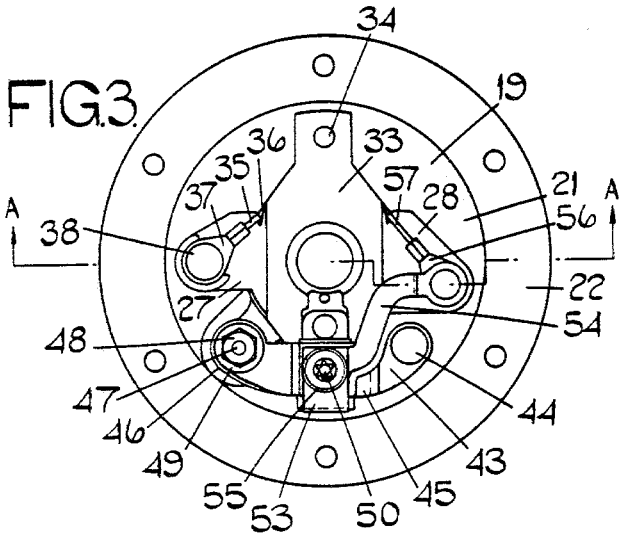
Figure 4:
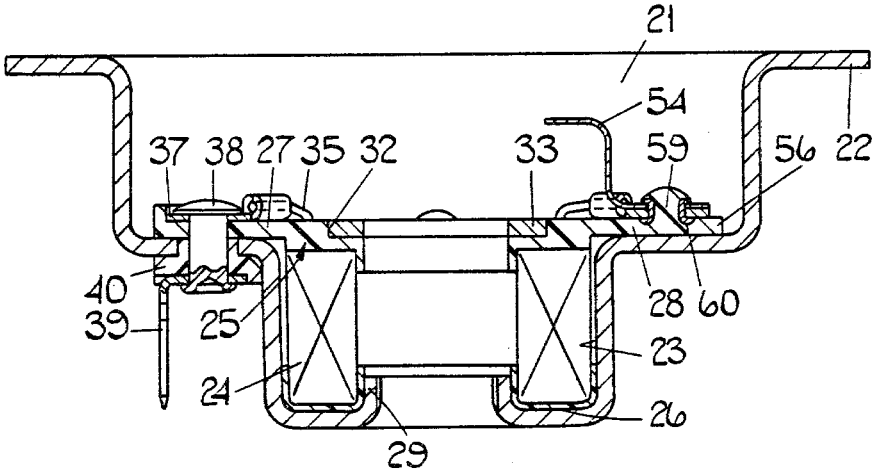
Figure 5:
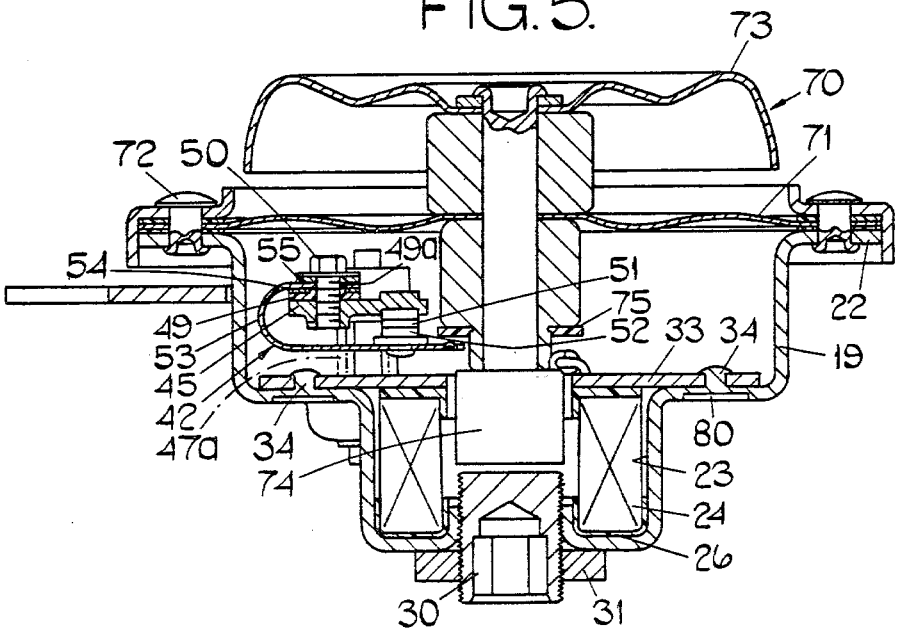

An embodiment of the present invention will now be described, by way of example, with reference to the accompanying drawings, in which:

FIG. 1 shows a stage in the manufacture of an electrical assembly according to one aspect of the present invention, FIG. 2 is a sectional view of the completed electrical assembly of FIG. 1, FIG. 3 is a plan view, with parts removed, of an electrical horn incorporating the electrical assembly of FIG. 2 and also incorporating an electrical coil assembly according to another aspect of the present invention, FIG. 4 is a sectional view on the line A—A of FIG. 3, and FIG. 5 is another sectional view of the electrical horn of FIGS. 3 and 4 but additionally showing a diaphragm assembly of the horn.

Referring now to FIGS. 1 and 2, an electrical assembly comprises a moulded, plate-like support member 10 which is moulded out of nylon (i.e. is electrically insulating) and which includes an integral post 11 extending therefrom. Formed within the support member 10 around the post 11 is an annular recess 12 which is of arcuate section. Mounted with clearance on the post 10 is a brass sleeve 13 having a downwardly and outwardly flared end 14 adjacent the support member 10. In the condition shown in FIG. 1, the end of the post 11 remote from the support member 10 projects a short distance above the adjacent end of the sleeve 13. Disposed in stacked relationship on the support member 10 is a pair of electrically conducting plates 15 and 16 which are to be electrically secured together and secured to the support member 10. The electrically conducting plates 15 and 16 are provided with respective apertures 17 and 18 therethrough. The apertures 17 and 18 are aligned although the aperture 17 is of greater diameter than the aperture 18. The plate 15 having the larger aperture 17 therethrough is disposed against the support member 10 and is thereby sandwiched between the support member 10 and the plate 16.

The partially assembled construction as illustrated in FIG. 1 is produced by inserting the brass sleeve 13 over the post 10 until the flared end 14 thereof engages in the recess 12. The plates 15 and 16 are then passed over the post 11 and sleeve 13 until the plate 15 engages against the support member 10, the post 11 and sleeve 13 projecting through the respective apertures 17 and 18 so that the ends of the post 11 and sleeve 13 remote from the support member 10 lie on the opposite side of the stacked plates 15 and 16 to the support member 10. In order to produce the completed electrical assembly, the support member 10 is held against movement in a manner to be described hereinafter and a tool is engaged against the free end of the post 11 which projects from the brass sleeve 13. The tool is forced towards the support member 10 and thus shortens the post 11. The tool also engages against the sleeve 13 and urges it downwardly against the support member 10 so that the flared end 14 of the sleeve 13 is deformed further outwardly and then rearwardly relative to the direction of movement of the tool by reason of engagement of the flared end 14 against the surface of the arcuate-section, annular recess 12. Further deformation of the flared end 14 of the sleeve 13 is prevented when the flared end 14 engages against the surface of the plate 15 adjacent the support member 10. Deformation of the post 11 also causes it to expand radially outwardly and so deform the sleeve radially outwardly over the free end portion thereof which is disposed on the opposite side of the stack of plates 15 and 16 to the support member 10. This produces an enlarged head portion 20 which serves to secure the plates 15 and 16 firmly in contact with one another and to secure them both with respect to the support 10. As can be seen from FIG. 2, the brass sleeve 13 engages the plate 16 around the aperture 18 therein whereby an effective electrical connection between the plates 15 and 16 is provided not only by direct contact therebetween but also via the sleeve 13. When the moulding tool is removed, the assembly remains in the condition shown in FIG. 2 because any tendency for the nylon post 11 to relax after the moulding tool is removed is prevented because the brass sleeve 13 is permanently deformed.

The manner in which the above-described electrical connection is provided in the electrical horn of FIGS. 3 to 5 will be described hereinafter.

Referring now to FIGS. 3 to 5, the electrical horn illustrated therein includes a dished body 19. The dished body 19 is provided with an open end 21 which is surrounded by a radially outwardly projecting apertured flange 22 integral with the body 19. The dished body 19 is configurated to define a recess 23 at an end thereof remote from the open end 21. Disposed with clearance within the recess 23 is an electrical coil assembly comprising a self-supporting electrical coil 24 and first and second nylon cheeks 25 and 26. The cheek 26 is of annular form and has a square U-shaped cross-section to receive the respective end of the coil 24. The other cheek 25 is disposed at the other end of the coil 24 and comprises a generally annular central portion and a pair of integral, radially outwardly extending support portions 27 and 28. The cheek 26 lies in the base of the recess 23 and conforms to the shape thereof, there being provided an integrally screw-threaded bush 29 integral with the dished body 19 extending into the recess 23. The bush 29 receives an externally screw-threaded pole member 30 provided with a lock nut 31. The pole member 30 is slotted to enable adjustment of the position thereof relatively to the coil 24 using a screwdriver to obtain the desired sound-making characteristics.

The support portions 27 and 28 are co-planar and disposed parallel to the cheek 25 so that a recess 32 is provided therebetween. An apertured metal retaining plate 33 is provided in the recess 32 and is secured in position by means of posts 34 which have been deformed in the manner of rivets. The posts 34 are integral with the body 19 and project into the recess thereof. The provision of these integral posts 34 obviates the need for the retainer plates 33 to be secured to the body 19 by rivets which pass through the body 19. Thus, the body 19 is less prone to water leakage. A lead 35 for one of the coils 24 projects through a notch 36 in the support portion 27 and is cold crimped to an eyelet 37 which is secured by means of a rivet 38 to a terminal 39 disposed externally of the body 19. The rivet 38 passes through the support portion 27 and through a nylon bushing 40. The support portion 28 is secured to the body 19 by adhesive. The bushing 40 not only serves to isolate the rivet 38 from the body 19 but also assists in providing a waterproof seal. The cold crimping of the lead 35 of the coil 24 to the eyelet 37 avoids the use of solder and it will be appreciated that stripping of the lead 35 in order to remove enamel thereon is avoided because the cold crimping operation, being a mechanical operation, breaks the electrical insulation and enables a good electrical connection between the lead 35 and the eyelet 37. A contact breaker assembly 42 is mounted within the dished body 19 and comprises a configurated metal plate 43 which is anchored at one end to the body 19 by means of a rivet 44. If desired, a post of a type similar to the above-described post 34 may be provided. The plate 43 includes a cranked portion 45 which extends parallel to and above the part of the body 19 from which one of the posts 34 extends. The cranked portion 45 terminates at its end remote from the rivet 44 in an annular portion 46. An elongate adjusting screw 47 having a head thereof disposed externally of the body 19 extends through the annular portion 46 and engages a hexagonal nut 48. The nut 48 is provided in a hexagonal recess in an electrically insulating plate member 49 which overlies the majority of the cranked portion 45 including the portion 46. The member 49 is secured to the cranked portion 45 by means of a fixing screw 50 engaging in a plunged hole in the cranked portion 45. A compression spring 47*a* is provided on the screw 47 and abuts at one of its ends against a metal washer supported by the internal surface of the body through the intermediary of an electrically insulating washer. The other end of the spring 47*a* abuts an insulating washer lying against the underside of the annular portion 46. Thus the spring 47*a* urges the plate member 49 against the nut 48. The cranked portion 45 carries a fixed contact 51 which is normally engaged with a moving contact 52 on a generally U-shaped blade spring 53. The fixing screw 50 passes through an aperture in that limb of the U-shaped blade spring 53 which does not carry the contact 52 and also passes through a configurated electrical connector 54 which is sandwiched between the blade spring 53 and the insulating member 49. An electrically insulating washer 55 under the head of the screw 50 and an integral collar 49*a* on the member 49 surrounding the screw 50, serve to isolate electrically the screw 50 from the electrical connector 54 and the blade spring 53. At its end remote from that fixed by the screw 50, the electrical connector 54 is connected with an eyelet 56 to which a lead 57 from the other end of the coil 24 is cold crimped in the manner described hereinbefore with reference to the first-mentioned lead 35 and its associated eyelet 37. The connector 54 and eyelet 56 are secured together and to the support portion 28 by means of a post 59 integral with the support portion 28 and an electrically conductive sleeve 60 disposed around the post 59. This connection is provided in the manner previously described hereinbefore in relation to FIGS. 1 and 2. With this form of construction, there is no need to use a fixing rivet which passes through the body 19 with its attendant sealing problems. To deform the post 59 and the sleeve 60, the moulding tool is inserted into the body 19 to engage the top of the post 59 whilst holding the body 19, and thus the support portion 28, against movement away from the tool.

The electrical horn further includes a diaphragm assembly 70 comprising a diaphragm 71 which is secured arounds its outer periphery to the flange 22 using rivets 72. The diaphragm assembly 70 further includes a tone disc 73 for modifying the sound produced by the horn, and an armature 74 which is secured to the centre of the diaphragm 71 and which extends axially of the horn to project through the retaining plate 33 and the cheek 25 to extend into the coil 24. Mounted on a portion of the armature 74 between the coil 24 and the diaphragm 71 is an electrically insulating contact breaker-operating disc 75. That limb of the blade spring 53 which carries the movable contact 52 is extended to a position in which it is disposed in the path of movement of the disc 75.

The modus operandi of the electrical corn described hereinabove is the same as that of conventional horns. Thus, when the coil 24 is energised, the armature 74 is drawn further into the coil 24 until the disc 75 has moved the blade spring 53 sufficiently far to separate the contacts 51 and 52 with the result that the coil 24 is de-energised allowing the armature 74 to be moved back to its original position under the influence of the spring effect of the diaphragm 71. In its original position, the disc 75 is spaced from the blade spring 53 and so allows the contacts 51 and 52 to close to re-establish the current flow through the coil 24, and so on.

The above-described horn has the following advantages:

(1) Because the use of rivets passing through the body 19 is minimized, the risk of water ingress in service is minimized.

(2) Because the coil is provided only with the end cheeks 25 and 26 and not with an internal sleeve, and because the body 19 is spaced from the outer periphery of the coil 24, a good air circulation is permitted around the coil 24 which reduces the risk of the coil burning out if the horn is operated for a long period of time.

(3) Stripping and soldering of the leads of the coil is obviated because they are cold crimped to the respective eyelet 37 and 56.

(4) The contact breaker assembly including the electrical connector 54 can be assembled outside the body 19 and then inserted into position as a complete subassembly.

The above-described electrical coil 24 can be produced by winding onto a temporary former, a copper wire which has been coated with a layer of insulation and a heat activatable adhesive. When the coil has been formed, it is heated in order to activate the heat activatable adhesive and then the temporary former is removed so that the coil 24 is completely self-supporting. Alternatively, a self-support coil may be formed by winding insulated copper wire onto a temporary former, then dipping the coil into an adhesive, and finally removing the temporary former.

If desired, the retaining plate 33 may be rivetted to the body 19 but this is not preferred for the reasons stated above. Also, if the retaining plate 33 is formed of a suitable material, it may be welded to the body 19. However, the provision of the posts 34 integral with the body 19 is preferred. Such post 34 are preferably formed by a so-called forward projection rivetting operation in which a tool is urged against the outer surface of the body 19 to deform meterial of the body inwardly so as to fill a die disposed internally of the body, the die having an internal configuration corresponding to the desired form of the post. In this operation, the tool which is of a greater diameter than the post produces a shallow depression 80 in the external surface of the body 19 (see FIG. 5).

I claim:

1. An electrical horn comprising a body a coil and associated armature mounted in said body, a diaphragm operatively connected with said armature, an electrical make-and-break mechanism mounted in said body, and means electrically connecting said make-and-break mechanism with said coil, wherein said electrical connecting means includes (a) a pair of electrically conducting members mounted in stacked relationship on an electrically insulating support member in said body (b) an electrically insulating post extending from said support member, an electrically conducting sleeve mounted on said post, said post and said sleeve extending through aligned apertures in said electrically conducting members and being deformed on the opposite side of the stack of electrically conducting members to said electrically insulating support member so as to secure said stack to said electrically insulating support member.

2. The electrical horn according to claim 1, wherein said sleeve and said post are deformed to provide an enlarged head portion on said opposite side of said stack so that said sleeve engages the outermost electrically conducting member around the aperture therein.

3. The electrical horn according to claim 1, wherein said electrically insulating support member is provided with a downwardly and outwardly curved surface around said post and the end of said sleeve adjacent said electrically insulating support member is deformed so as to lie against said surface and to be in contact with the electrically conductive member adjacent said support member.

4. The electrical horn according to claim 3, wherein said downwardly and outwardly curved surface is provided as a wall of an annular recess in said electrically insulating support member around said post.

5. The electrical horn according to claim 1, wherein said coil is self-supporting, a pair of electrically insulating flanges are provided at opposite ends of said coil, and means hold said flanges against said ends of said coil, said holding means being disposed externally of said coil and spaced from the outer periphery thereof.

6. The electrical horn according to claim 5, wherein said body has a recess therein in which said coil and said flanges are disposed with one of said flanges abutting a base of said recess, and said holding means comprises a wall of said recess and at least one retainer member which retains the other flange in position, said retainer member projecting outwardly of an open end of said recess and being secured to said body.

7. The electrical horn according to claim 6, wherein said at least one retainer member includes a portion extending integrally of said other flange.

8. The electrical horn according to claim 6, wherein said at least one retainer member includes a separate retainer member which is engaged with said other flange.

9. The electrical horn according to claim 6, wherein said at least one retainer member comprises a pair of members extending integrally from said other cheek and a further, separate retainer member extending across said open end of said recess.

10. The electrical horn according to claim 5 wherein said electrically insulating support is integral with one of the flanges.

11. The electrical horn according to claim 6 wherein said retainer member is secured to said body by at least one post which projects integrally from said body through an aperture, in said retainer member and which has a head formed by deformation of said post.

12. An electrical horn comprising a body, a self-supporting coil and associated armature mounted in said body, a diaphragm operatively connected with said armature, an electrical make-and-break mechanism mounted in said body, means electrically connecting said make-and-break mechanism with said self-supporting coil, a pair of electrically insulating flanges provided at opposite ends of said self-supporting coil, and means for holding said flanges against said ends of said self-supporting coil, said holding means being disposed externally of said self-supporting coil and spaced from the outer periphery thereof.

13. The electrical horn according to claim 12 wherein said body has a recess therein in which said coil and said flanges are disposed with one of said flanges abutting a base of said recess, and said holding means comprises a wall of said recess and at least one retainer member which retains the other flange in position, said retainer member projecting outwardly of an open end of said recess and being secured to said body.

14. The electrical horn according to claim 13, wherein said at least one retainer member includes a portion extending integrally of said other flange.

15. The electrical horn according to claim 13 wherein said at least one retainer member includes a separate retainer member which is engaged with said other flange.

16. The electrical horn according to claim 13, wherein said at least one retainer member comprises a pair of members extending integrally from said other cheek and a further separate retainer member extending across said open end of said recess.

* * * * *